US009334743B2

(12) United States Patent
Alvanos et al.

(10) Patent No.: US 9,334,743 B2
(45) Date of Patent: May 10, 2016

(54) CERAMIC MATRIX COMPOSITE AIRFOIL FOR A GAS TURBINE ENGINE

(75) Inventors: Ioannis Alvanos, West Springfield, MA (US); Gabriel L. Suciu, Glastonbury, CT (US); Douglas M. Berczik, Manchester, CT (US); John D. Riehl, Hebron, CT (US); Kevin L. Rugg, Fairfield, CT (US)

(73) Assignee: United Technologies Corporation, Hartford, CT (US)

( * ) Notice: Subject to any disclaimer, the term of this patent is extended or adjusted under 35 U.S.C. 154(b) by 931 days.

(21) Appl. No.: 13/116,246

(22) Filed: May 26, 2011

(65) Prior Publication Data

US 2012/0301315 A1 Nov. 29, 2012

(51) Int. Cl.

| | |
|---|---|
| ***F01D 5/28*** | (2006.01) |
| ***F01D 9/04*** | (2006.01) |
| ***F01D 5/34*** | (2006.01) |
| ***F01D 11/00*** | (2006.01) |
| ***F01D 25/24*** | (2006.01) |

(52) U.S. Cl.

CPC ..... *F01D 5/284* (2013.01); *F01D 5/282* (2013.01); *F01D 5/34* (2013.01); *F01D 9/041* (2013.01); *F01D 11/001* (2013.01); *F01D 25/246* (2013.01); *F05D 2240/12* (2013.01); *F05D 2300/6033* (2013.01)

(58) Field of Classification Search

CPC ..... F01D 5/282; F01D 5/284; F01D 5/34; F01D 11/001; F01D 9/041; F01D 9/042; F01D 9/0444; F01D 25/246; F05D 2300/6033

USPC ..... 415/191, 200, 208.1, 208.2, 415/209.2–209.4, 210.1, 189–190; 416/229 R, 229 A, 230, 241 B, 189–192, 416/193 R, 193 A; 264/640, 642, 682, 683; 29/889.7, 889.71, 889.72, 889.721; 156/89.11, 242, 245

See application file for complete search history.

(56) References Cited

U.S. PATENT DOCUMENTS

| | | | | |
|---|---|---|---|---|
| 5,131,808 | A | 7/1992 | Ciais et al. | |
| 6,196,794 | B1 | 3/2001 | Matsumoto | |
| 6,200,092 | B1 | 3/2001 | Koschier | |
| 6,312,224 | B1 * | 11/2001 | Knott et al. | 416/230 |
| 7,066,717 | B2 | 6/2006 | Morrison et al. | |
| 7,153,096 | B2 | 12/2006 | Thompson et al. | |
| 7,258,530 | B2 | 8/2007 | Morrison et al. | |
| 7,384,240 | B2 | 6/2008 | McMillan et al. | |

(Continued)

FOREIGN PATENT DOCUMENTS

| | | |
|---|---|---|
| EP | 2210733 | 11/2009 |
| EP | 2363574 | 2/2011 |

OTHER PUBLICATIONS

European Search Report, mailed Jan. 14, 2015.

*Primary Examiner* — Christopher Verdier

(74) *Attorney, Agent, or Firm* — Carlson, Gaskey & Olds, P.C.

(57) ABSTRACT

A Ceramic Matrix Composites (CMC) airfoil for a gas turbine engine includes a first multiple of CMC plies which define a suction side, a first airfoil portion of the first multiple of CMC plies at least partially parallel to an airfoil axis. A second multiple of CMC plies define a pressure side, a second airfoil portion of the second multiple of CMC plies at least partially parallel to the airfoil axis and bonded to the first airfoil portion.

13 Claims, 7 Drawing Sheets

(56) References Cited

U.S. PATENT DOCUMENTS

| | | | | |
|---|---|---|---|---|
| 2006/0127217 | A1* | 6/2006 | McMillan et al. | 415/200 |
| 2006/0283014 | A1* | 12/2006 | Subramanian et al. | 29/889.71 |
| 2007/0154307 | A1* | 7/2007 | Cairo | 415/209.3 |
| 2007/0166151 | A1* | 7/2007 | Burdgick et al. | 415/191 |
| 2008/0124512 | A1* | 5/2008 | Steibel et al. | 428/105 |
| 2008/0220207 | A1* | 9/2008 | Ravey | 428/119 |
| 2010/0189566 | A1* | 7/2010 | Harrison | 415/200 |
| 2011/0027098 | A1 | 2/2011 | Noe et al. | |
| 2011/0206522 | A1* | 8/2011 | Alvanos et al. | 416/204 R |
| 2011/0311368 | A1 | 12/2011 | Coupe et al. | |

* cited by examiner

CERAMIC MATRIX COMPOSITE AIRFOIL FOR A GAS TURBINE ENGINE

BACKGROUND

The present disclosure relates to a gas turbine engine, and more particularly to Ceramic Matrix Composites (CMC) components therefor.

The turbine section of a gas turbine engine includes a multiple of airfoils which operate at elevated temperatures in a strenuous, oxidizing type of gas flow environment and are typically manufactured of high temperature superalloys. CMC materials provide higher temperature capability than metal alloys and a high strength to weight ratio. CMC materials, however, may require particular manufacturing approaches as the fiber orientation primarily determines the strength capability.

SUMMARY

A Ceramic Matrix Composites (CMC) airfoil for a gas turbine engine according to an exemplary aspect of the present disclosure includes a first multiple of CMC plies which define a suction side, a first airfoil portion of the first multiple of CMC plies at least partially parallel to an airfoil axis. A second multiple of CMC plies define a pressure side, a second airfoil portion of the second multiple of CMC plies at least partially parallel to the airfoil axis and bonded to the first airfoil portion.

A Ceramic Matrix Composites (CMC) airfoil for a gas turbine engine according to an exemplary aspect of the present disclosure includes a first multiple of CMC plies which define a suction side, a first airfoil portion of the first multiple of CMC plies at least partially parallel to an airfoil axis and a first fillet portion of the first multiple of CMC plies transverse to the airfoil axis. A second multiple of CMC plies define a pressure side, a second airfoil portion of second multiple of CMC plies at least partially parallel to the airfoil axis and a second fillet portion of the second multiple of CMC plies transverse to the airfoil axis. A third multiple of CMC plies bonded to the first fillet portion of the first multiple of CMC plies and the second fillet portion of the second multiple of CMC plies, the third multiple of CMC plies transverse to the airfoil axis to define a generally triangular area. A CMC fabric filler material within the generally triangular area.

A method of forming a Ceramic Matrix Composite airfoil for a gas turbine engine according to an exemplary aspect of the present disclosure includes forming a suction side from a first multiple of CMC plies, a first airfoil portion of the first multiple of CMC plies at least partially parallel to an airfoil axis; forming a pressure side from a second multiple of CMC plies, a second airfoil portion of the second multiple of CMC plies at least partially parallel to the airfoil axis; and bonding the first airfoil portion of the first multiple of CMC plies to the second airfoil portion of the second multiple of CMC plies.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
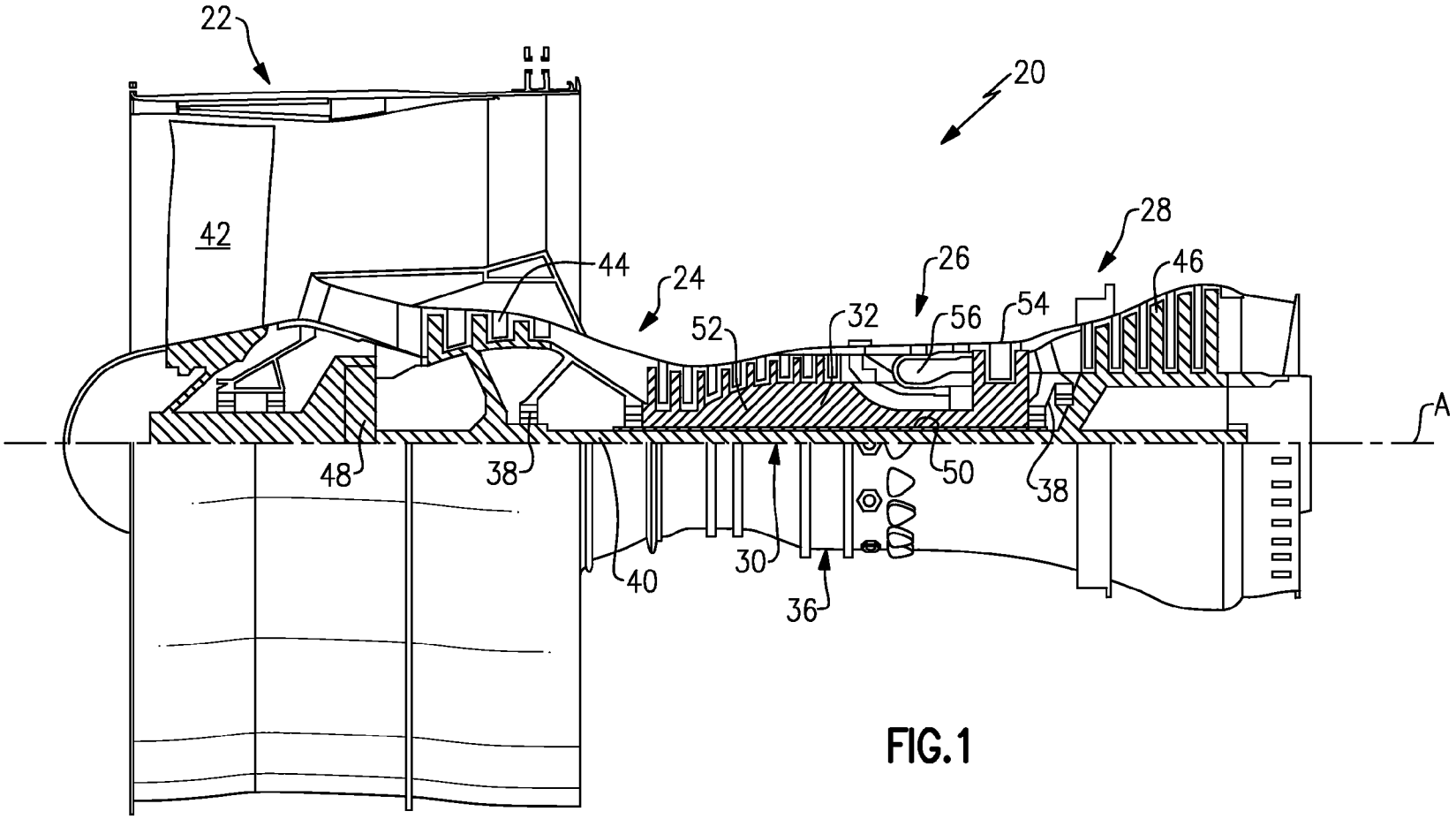
FIG. 1 is a schematic cross-section of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flowpath while the compressor section 24 drives air along a core flowpath for compression and communication into the combustor section 26 then expansion through the turbine section 28. Although depicted as a turbofan gas turbine engine in the disclosed non-limiting embodiment, it should be understood that the concepts described herein are not limited to use with turbofans as the teachings may be applied to other types of turbine engines.

The engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that interconnects a fan 42, a low pressure compressor 44 and a low pressure turbine 46. The inner shaft 40 is connected to the fan 42 through a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged between the high pressure compressor 52 and the high pressure turbine 54. The inner shaft 40 and the outer shaft 50 are concentric and rotate about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The turbines 54, 46 rotationally drive the respective low speed spool 30 and high speed spool 32 in response to the expansion.

Figure 2:
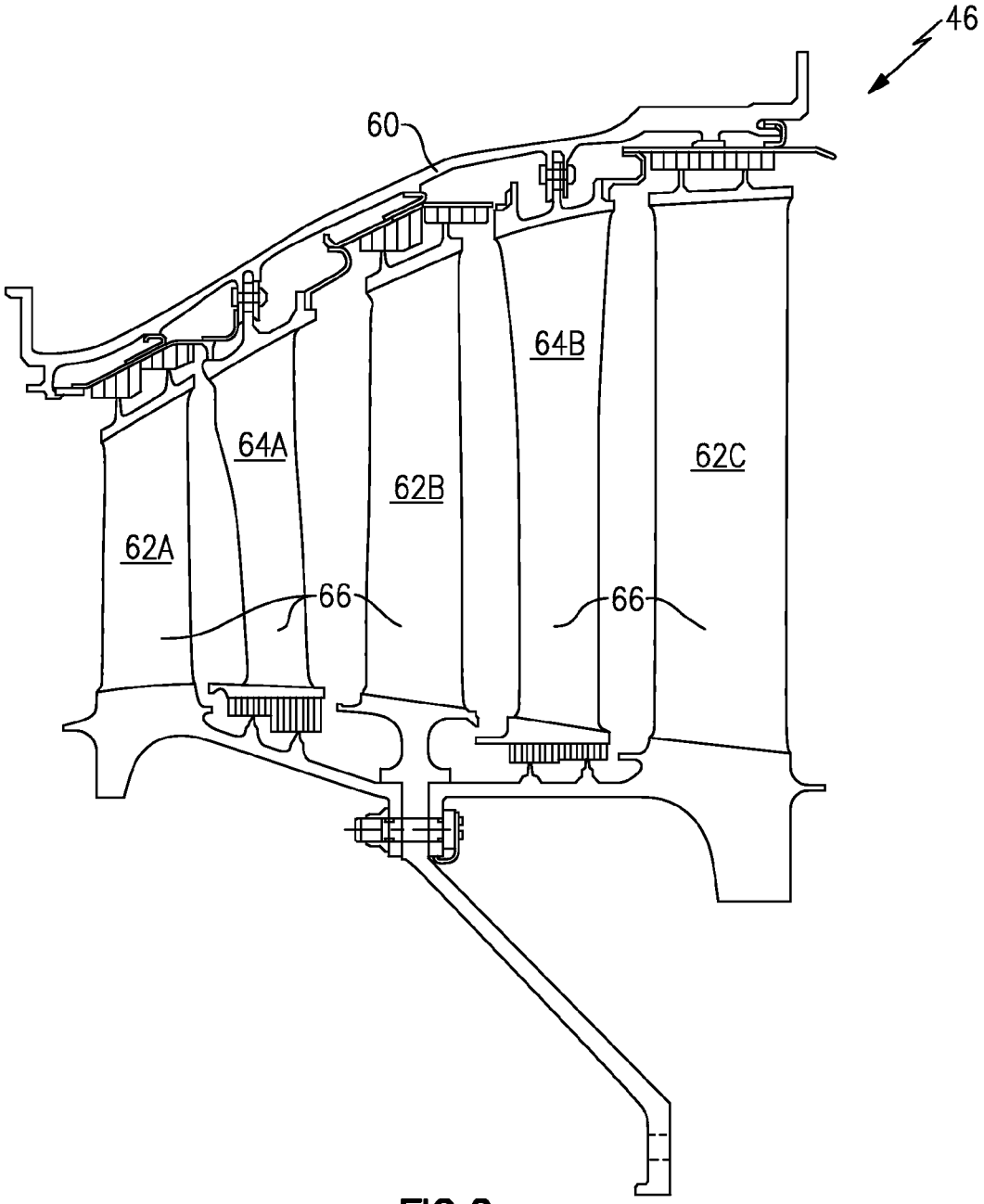
FIG. 2 is an enlarged sectional view of a Low Pressure Turbine section of the gas turbine engine.
Figure 3:
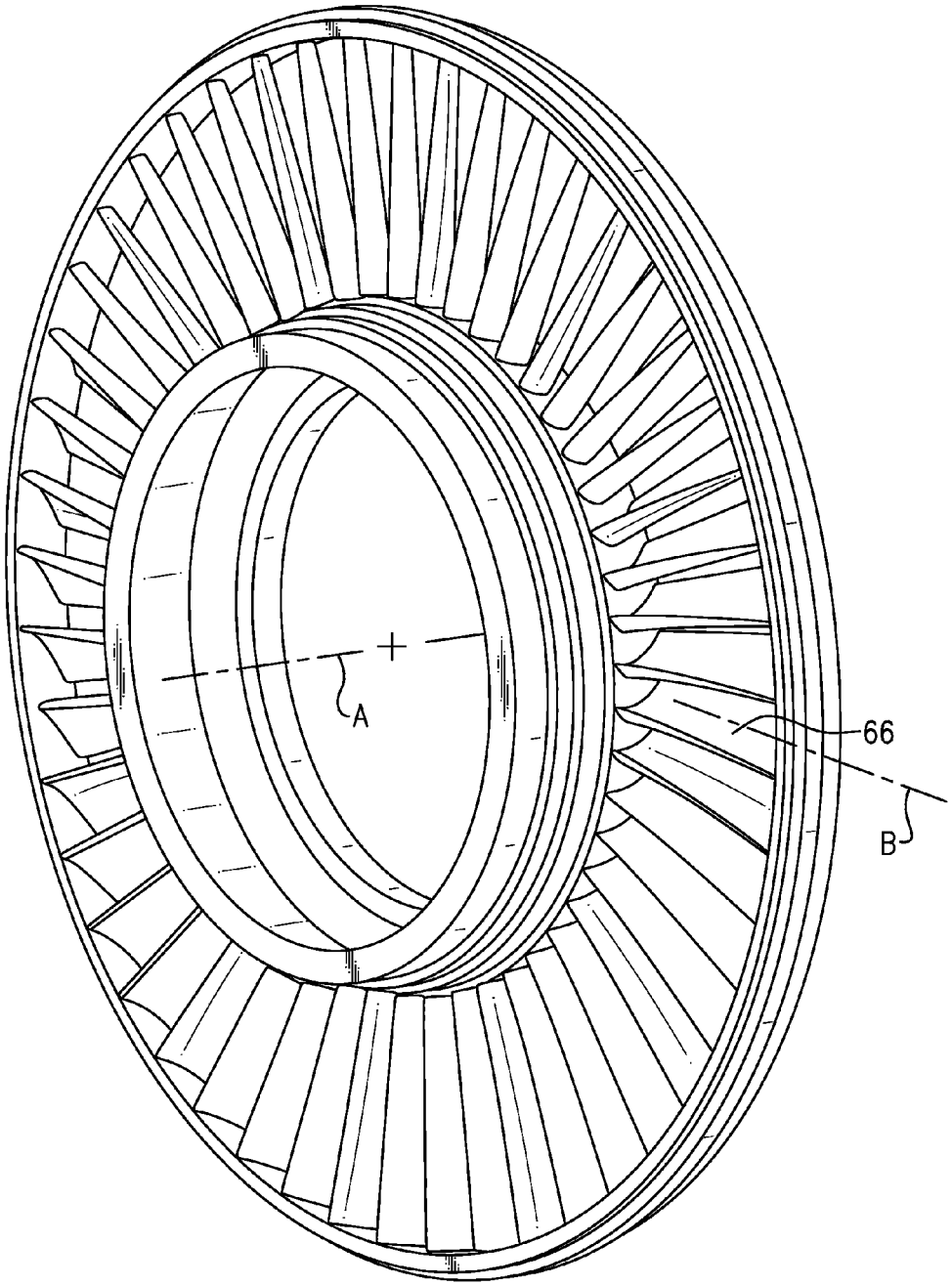
FIG. 3 is an enlarged perspective view of an example rotor disk of the Low Pressure Turbine section.
Figure 4:
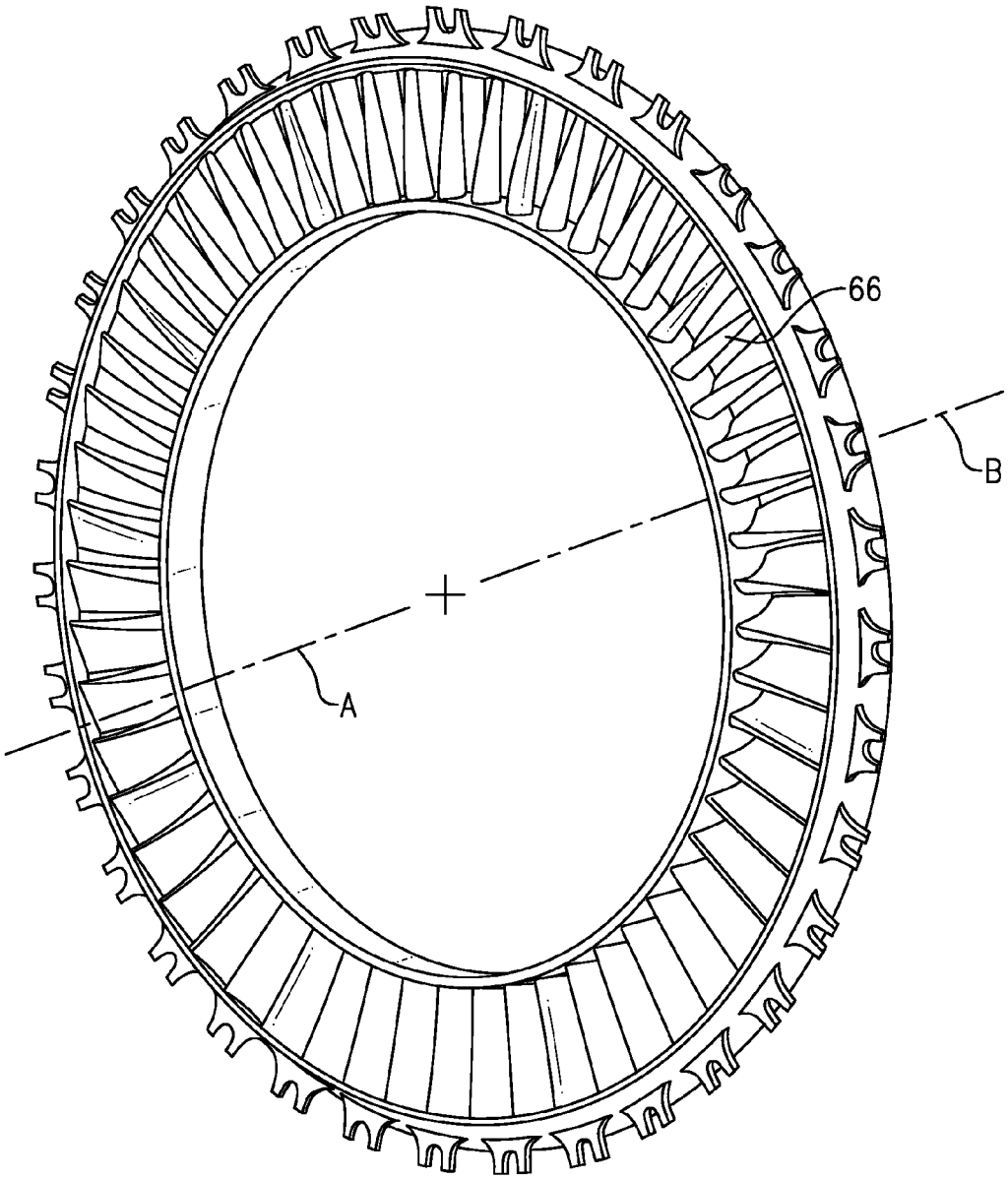
FIG. 4 is an enlarged perspective view of an example stator vane structure of the Low Pressure Turbine section.

With reference to FIG. 2, the low pressure turbine 46 generally includes a low pressure turbine case 60 with a multiple of low pressure turbine stages. The stages include a multiple of rotor structures 62A, 62B, 62C interspersed with vane structures 64A, 64B. Each of the rotor structures 62A, 62B, 62C and each of the vane structure 64A, 64B may include airfoils 66 manufactured of a ceramic matrix composite (CMC) material typically in a ring-strut ring full hoop structure (FIGS. 3 and 4). It should be understood that examples of CMC material for all componentry discussed herein may include, but are not limited to, for example, S200 and SiC/SiC. It should also be understood that the term full hoop is defined herein as an uninterrupted member such that the vanes do not pass through apertures formed therethrough. Although depicted as a low pressure turbine in the disclosed embodiment, it should be understood that the concepts described herein are not limited to use with low pressure turbine as the teachings may be applied to other sections such as high pressure turbine, high pressure compressor, low pressure compressor and intermediate pressure turbine and intermediate pressure turbine of a three-spool architecture gas turbine engine.

Figure 5:
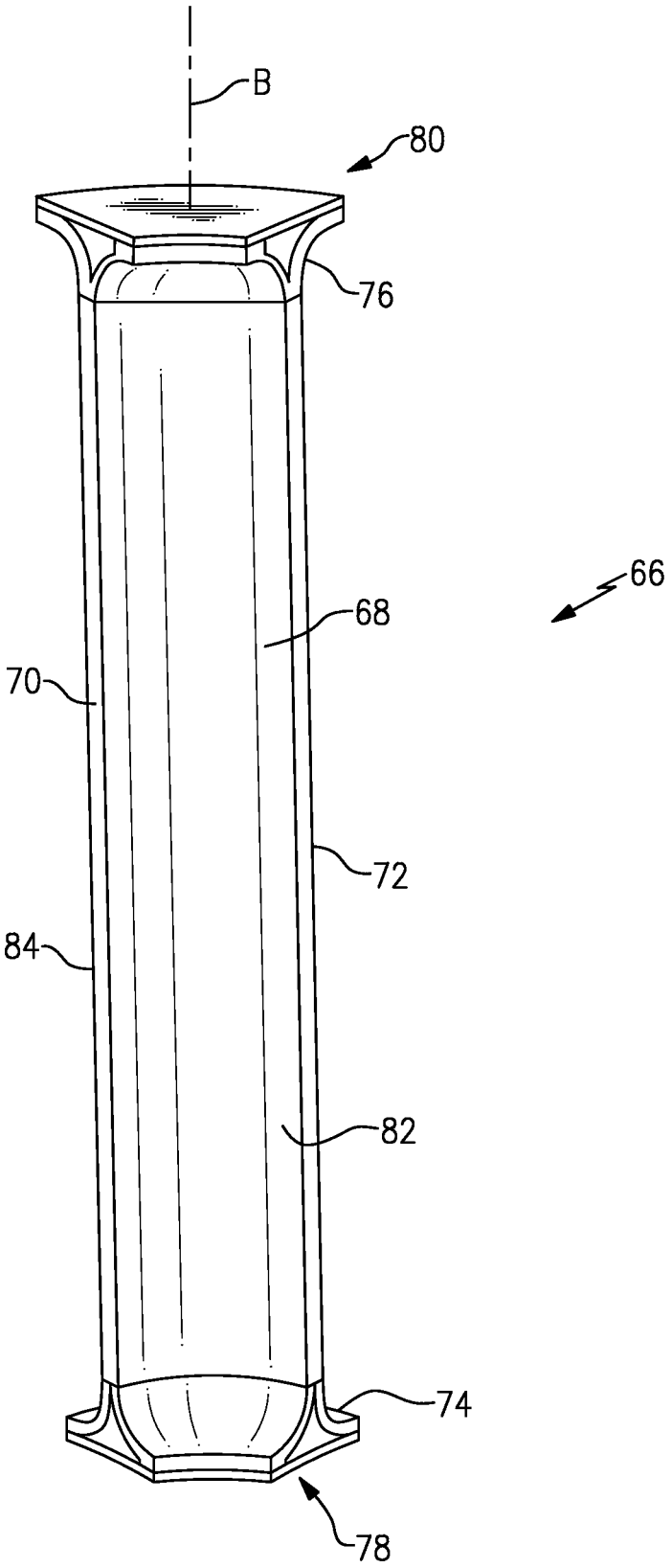
FIG. 5 is a perspective view of a CMC vane structure for a gas turbine engine.

With reference to FIG. 5, one CMC airfoil 66 usable with a ring-strut-ring full hoop structure is illustrated. Although a somewhat generic airfoil 66 will be described in detail hereafter, it should be understood that various rotary airfoils or blades and static airfoils or vanes such as those within the low pressure turbine 46 and high pressure compressor 52 may be particularly amenable to the fabrication described herein.

The CMC airfoil 66 generally includes an airfoil portion 68 defined between a leading edge 70 and a trailing edge 72. Each airfoil 66 may include a fillet section 74, 76 to provide a transition between the airfoil portion 68 and a platform segment 78, 80. The platform segments 78, 80 form the inner diameter and the outer diameter of the core gas path. The airfoil portion 68 includes a generally concave shaped portion which forms a pressure side 82 and a generally convex shaped portion which forms a suction side 84.

Figure 6:
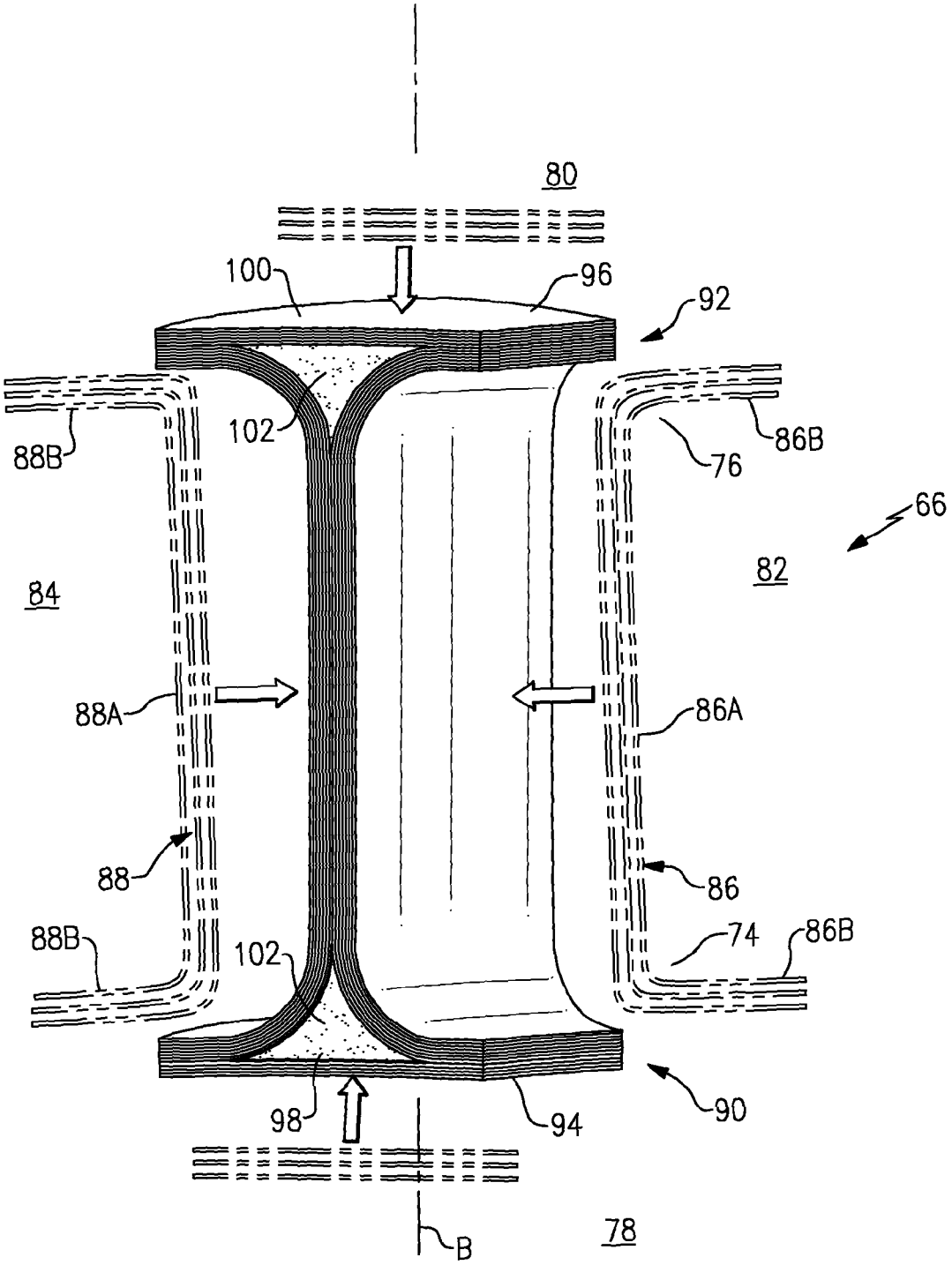
FIG. 6 is an exploded view of the CMC vane structure illustrating a ply arrangement disclosed herein.

With reference to FIG. 6, the fabrication of each CMC airfoil 66 may be performed in several steps to form the various features. The pressure side 82 and the suction side 84 are formed from a respective first and second multiple of CMC plies 86, 88 which may be bonded together along the central portion of an airfoil axis B within a first airfoil portion 86A, 88A which is at least partially parallel to the airfoil axis B of the airfoil portion 68. The airfoil portion 68 may be fabricated such that the CMC structural fibers of the respective first and second multiple of CMC plies 86, 88 are arranged to define a radius outward from the airfoil axis B. That is, the pressure side 82 and the suction side 84 along with the inner and outer core gas path forming platform segments 78, 80 are formed with a generally "C" shaped CMC ply orientation by the respective first and second multiple of CMC plies 86, 88.

The multiple of CMC plies 86, 88 bend apart to define a generally perpendicular orientation to form the fillets 74, 76. That is, the multiple of CMC plies 86, 88 bend apart at a second airfoil portion 86B, 88B which is at least partially transverse to the airfoil axis B to form the fillet sections 74, 76. The fillet sections 74, 76 define the core gas path surface which blend the airfoil portion 68 into the platform segments 78, 80. The outer cap surfaces 90, 92 of the platform segments 78, 80 are then capped by, for example, a third and fourth multiple of CMC plies 94, 96 which are generally transverse to the airfoil axis B. The platform segments 78, 80 may additionally or alternatively include fabric plies to obtain a thicker section if so required.

The outer cap surfaces 90, 92 of the platform segments 78, 80 utilize the CMC hoop strength characteristics to form an integrated bladed rotor with a full hoop shroud to form a ring-strut-ring structure. It should be understood that the term full hoop is defined herein as an uninterrupted member such that the vanes do not pass through apertures formed therethrough.

Triangular areas 98, 100 at which the multiple of CMC uni-tape plies 86, 88 bend apart to form the fillets 74, 76 are filled with a CMC fabric filler materials 102 such as chopped fiber and a tackifier. The CMC fabric filler material may additionally be utilized in areas where pockets or lack of material will exist relative to the forming of a feature. These areas may possess debited properties but will be located in areas where they may exist without compromising structural integrity.

Figure 7:
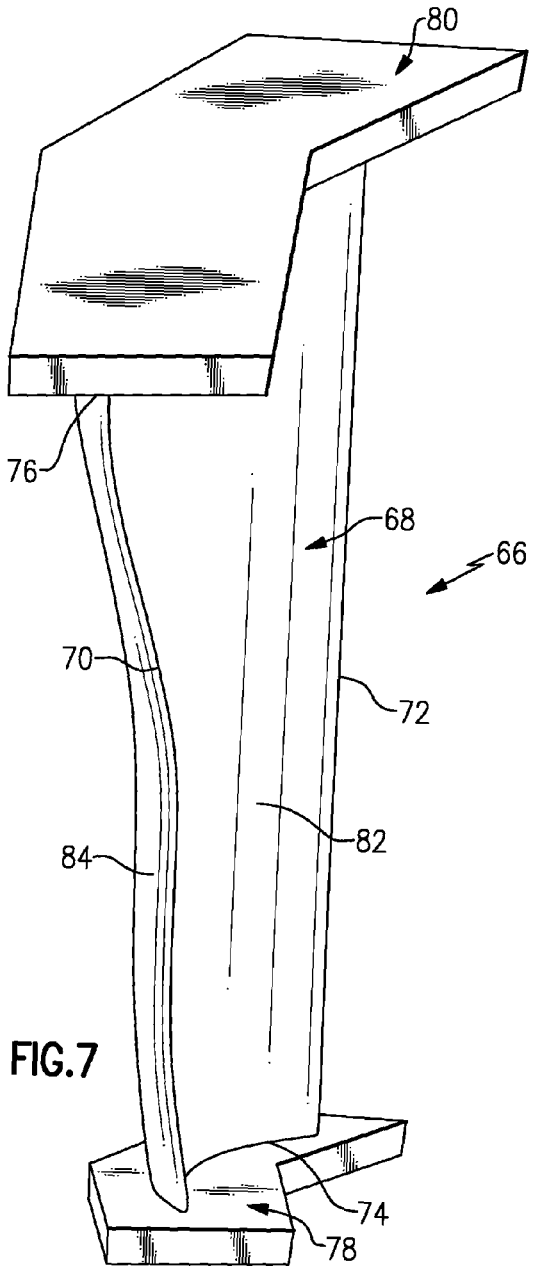
FIG. 7 is a perspective schematic view of the CMC airfoil structure illustrating a chevron platform.
Figure 8:
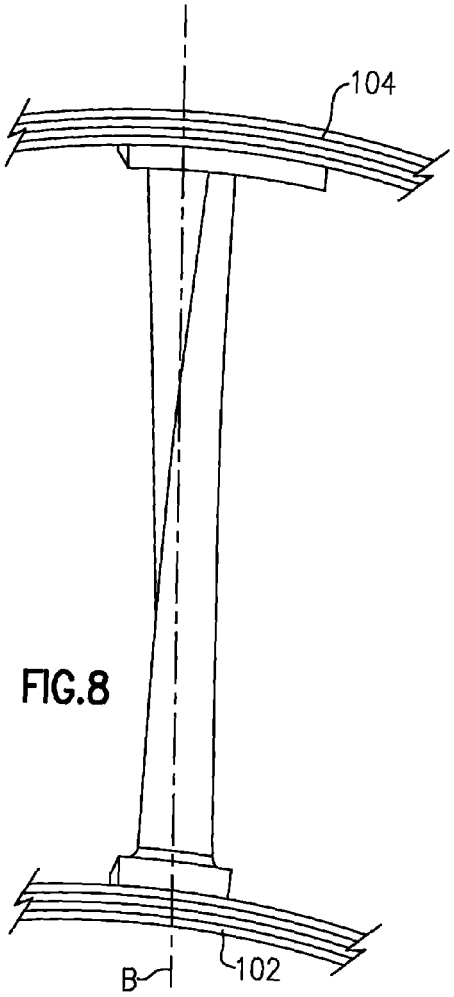
FIG. 8 is an enlarged front perspective view of a CMC airfoil bonded within an inner and outer full hoop ring.

In the disclosed non-limiting embodiment, the platform segments 78, 80 may be chevron-shaped (FIG. 7) to provide a complementary geometry for abutting edge engagement of each adjacent platform segment to define the inner and outer core gas path. That is, the CMC airfoils 66 are assembled in an adjacent complementary manner to form a ring of airfoils which are further wrapped with a CMC outer ring 104 and a CMC inner ring 102 about the multiple of the respectively adjacent platform segments 78, 80 to form full hoops (FIG. 8). It should be understood that appropriate twist and the like may be readily included.

The disclosed fabrication approach allows for ease of production for a single or multiple airfoil cluster based on relatively simple shapes joined together to form the relatively more complex airfoil structure.

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A Ceramic Matrix Composite airfoil for a gas turbine engine comprising:

a first multiple of CMC plies which define a convex suction side with a first airfoil portion of said first multiple of CMC plies at least partially parallel to an airfoil axis;

a second multiple of CMC plies which define a concave pressure side with a second airfoil portion of said second multiple of CMC plies at least partially parallel to said airfoil axis, said first airfoil portion and said second airfoil portion co-extending between leading and trailing edges, and said first and second airfoil portions are generally "C"-shaped;

first and second fillet portions of said first multiple of CMC plies transverse to said airfoil axis on first and second ends of said first airfoil portion, respectively;

first and second fillet portions of said second multiple of CMC plies transverse to said airfoil axis on first and second ends of said second airfoil portion, respectively;

a third multiple of CMC plies bonded to said first fillet portion of said first multiple of CMC plies and said first fillet portion of said second multiple of CMC plies, said third multiple of CMC plies transverse to said airfoil axis to define a first generally triangular area at said leading and trailing edges; and a fourth multiple of CMC plies bonded to said second fillet portion of said first multiple of CMC plies and said second fillet portion of said second multiple of CMC plies, said fourth multiple of CMC plies transverse to said airfoil axis to define a second generally triangular area at said leading and trailing edges, wherein said first airfoil portion has a center portion between first and second ends and said leading and trailing edges of said first airfoil portion, the second airfoil portion has a center portion between first and second ends and said leading and trailing edges of the second airfoil portion, and said first and second airfoil portions are bonded together along said respective center portions.

2. The Ceramic Matrix Composite airfoil as recited in claim 1, further comprising a CMC fabric filler material within said first and second generally triangular areas.

3. The Ceramic Matrix Composite airfoil as recited in claim 2, wherein said CMC fabric filler material includes chopped fiber and a tackifier.

4. The Ceramic Matrix Composite airfoil as recited in claim 1, wherein said third and fourth multiples of CMC plies at least partially define a chevron shape.

5. The Ceramic Matrix Composite airfoil as recited in claim 1, wherein said suction side and said pressure side form a low pressure turbine blade.

6. The Ceramic Matrix Composite airfoil as recited in claim 1, wherein said suction side and said pressure side form a low pressure turbine vane.

7. The Ceramic Matrix Composite airfoil as recited in claim 1, wherein said first and second airfoil portions are not bonded to one another at said first and second ends of said first and second airfoil portions, respectively.

8. The Ceramic Matrix Composite airfoil as recited in claim 1, wherein said first triangular area has a first side defined by said first fillet portion of said first multiple of CMC plies, a second side defined by said first fillet portion of said second multiple of CMC plies, and a third side defined by said third multiple of CMC plies.

9. The Ceramic Matrix Composite airfoil as recited in claim 1, wherein said second triangular area has a first side defined by said second fillet portion of said first multiple of CMC plies, a second side defined by said second fillet portion of said second multiple of CMC plies, and a third side defined by said fourth multiple of CMC plies.

10. The Ceramic Matrix Composite airfoil as recited in claim 1, wherein said third multiple of CMC plies is continuously bonded to said first fillet portion of said first multiple of CMC plies and said first fillet portion of said second multiple of CMC plies aft and forward of said first generally triangular area.

11. The Ceramic Matrix Composite airfoil as recited in claim 10, wherein said fourth multiple of CMC plies is continuously bonded to said second fillet portion of said first multiple of CMC plies and said second fillet portion of said second multiple of CMC plies aft and forward of said second generally triangular area.

12. The Ceramic Matrix Composite airfoil as recited in claim 1, wherein said third multiple of CMC plies is not bonded to said first fillet portion of said first multiple of CMC plies and said first fillet portion of said second multiple of CMC plies adjacent said center portion.

13. The Ceramic Matrix Composite airfoil as recited in claim 12, wherein said fourth multiple of CMC plies is not bonded to said second fillet portion of said first multiple of CMC plies and said second fillet portion of said second multiple of CMC plies adjacent said center portion.

* * * * *